United States Patent [19]

Junker

[11] 4,127,904

[45] Dec. 5, 1978

[54] WATER CLOSET SEAT AND BIDET ASSEMBLY

[76] Inventor: Arnold E. Junker, 24 Sunburst Rd., Bridgeport, Conn. 06606

[21] Appl. No.: 830,556

[22] Filed: Sep. 6, 1977

[51] Int. Cl.[2] ..... A47K 3/22

[52] U.S. Cl. ..... 4/7

[58] Field of Search ..... 4/6, 7

[56] References Cited

U.S. PATENT DOCUMENTS

| | | | |
|---|---|---|---|
| 2,036,984 | 4/1936 | Salvoni | 4/6 |
| 2,080,438 | 5/1937 | Salvoni | 4/6 |
| 3,467,966 | 9/1969 | Gregori et al. | 4/7 |
| 3,528,112 | 9/1970 | Warnick | 4/7 X |
| 3,577,567 | 5/1971 | Wintercorn | 4/7 |
| 3,781,919 | 1/1974 | Ayala | 4/7 |
| 3,795,015 | 3/1974 | Talge et al. | 4/7 |
| 3,808,608 | 5/1974 | Caplan | 4/7 |
| 3,900,902 | 8/1975 | Jarosinski | 4/7 |

*Primary Examiner*—Henry K. Artis

*Attorney, Agent, or Firm*—Thomas L. Tully

[57] ABSTRACT

A combination toilet seat and bidet adapted for use on conventional toilets, comprising a seat portion and a cover portion hingedly-connected to each other to form a unit which is preferably pivotably-connected to a mounting member which is adapted to be connected to the seal-mounting holes of a conventional toilet. The cover portion preferably includes a water spray attachment which is adapted to be connected to a water source. The attached unit is convertible between normal seat-down position and cover-under or bidet position by lifting the unit from the front, pivoting it 180° on the mounting member and then lowering the front of the unit so that the unit rests on the toilet in inverted or upside down position.

9 Claims, 4 Drawing Figures

WATER CLOSET SEAT AND BIDET ASSEMBLY

BACKGROUND OF THE INVENTION

Toilets or water closets conventionally-made and sold in the United States are relatively simple devices which function as recepticles and disposals. More expensive and more complicated toilets or water closets are available here and are common in Europe which also function as bidets or sitz baths for personal hygiene purposes. It is impractical and unsanitary to attempt to modify a conventional toilet by including the necessary spray device within the bowl thereof to convert the toilet to a bidet. It has been proposed to provide a toilet seat having a spray attachment pivotably attached to the underside thereof for movement out of position within the bowl during non-use. Such a combination is also impractical and unsanitary due to the lack of concealment space available within the bowl.

SUMMARY OF THE INVENTION

The novel toilet seat and bidet unit of the present invention is adapted for attachment to any conventional toilet or water closet in place of the conventional seat and cover unit. The present unit, in normal seating position, has a conventional seating surface devoid of any spray attachments thereon or thereunder within the bowl, and thus is completely sanitary. However, the present unit is reversible for personal hygiene or washing purposes to provide a second seating surface, preferably having closely-spaced therebelow a spray element and, according to a preferred embodiment, a wash basin adapted to either retain or drain away washing liquids, medicaments or other liquids as may be used for sanitary or medicinal purposes.

It is the principal object of the present invention to provide an attachment unit for a conventional toilet or water closet, in place of the ordinary seat and cover unit, to adapt the toilet or water closet to be used in convenient and sanitary fashion as a bidet or sitz bath.

It is another object to the present invention to provide an attachment unit of the foregoing type which is attached to the toilet or water closet, devoid of removable pans or spray units which must be separately stored.

It is yet another object of the present invention to provide a unit of the foregoing type which is sanitary in that there is no spray unit, pan or other element disposed within the bowl of the toilet or water closet when the unit is in normal seating position.

It is an object according to one embodiment of the present invention, to provide a unit of the foregoing type which also includes a wash basin adapted to retain cleaning liquids or medicinal liquids as may be required for personal hygiene or medicinal treatment purposes, with plug means being provided to retain such liquids during use and to release such liquids to within the bowl of the toilet after use.

These and other objects and advantages of the present invention will be apparent to those skilled in the art in the light of the present disclosure, including the drawings.

DESCRIPTION OF THE PREFERRED EMBODIMENT

Figure 1:
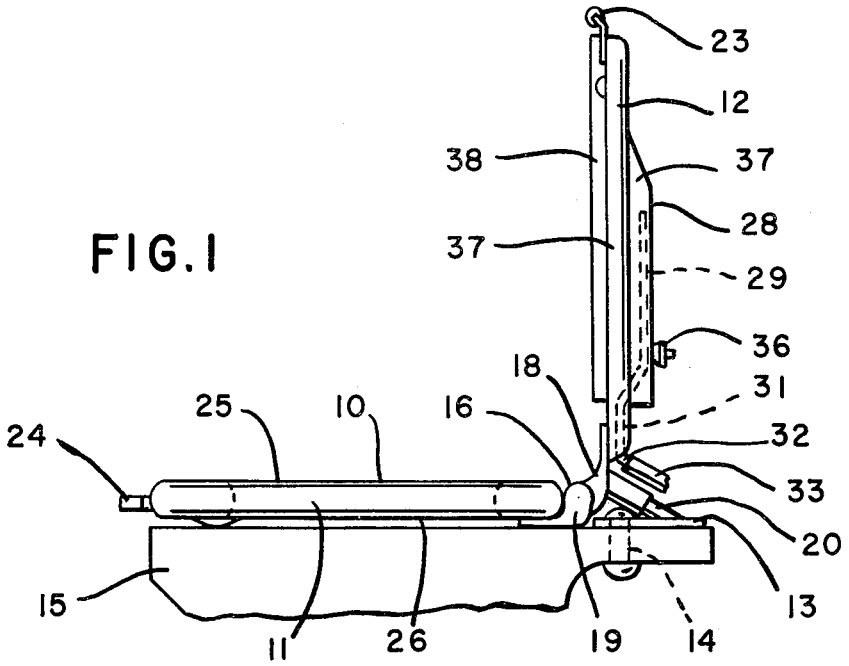
FIG. 1 is a side view of a novel toilet seat-bidet assembly according to one embodiment of the present invention, attached to a conventional water closet in normal seat-down position with the cover portion raised.

Referring to the drawings, the novel toilet seat-bidet units 10 of the present invention comprise a seat portion 11 and a cover portion 12 hingedly-connected to each other to form a unit which preferably is pivotably-connected to a mounting member 13 which is adapted to be connected to the seat-mounting holes 14 of a conventional water closet 15.

The hinge connection 16 between the seat portion 11 and the cover portion 12 may be of the conventional type including a shaft 17 which passes through bushings 18 attached to the cover portion 12 and into cup bushings 19 attached to the seat portion 12.

Preferably, as illustrated, the shaft 17 is hingedly and pivotably attached to the mounting member 13 by means of a telescoping shaft 20 which is attached to the hinge shaft 17 and to the mounting member 13. The telescoping shaft 20 is free turning whereby the unit 10 may be gripped in one hand from the front by means of handles 23 and 24, attached to the cover portion 12 and the seat portion 22 respectively, lifted out of contact with the water closet 15, pivoted a full 180° to inverted position and then repositioned in contact with the water closet.

The telescoping ability of shaft 20 is important in cases where the size of the unit 10 and the proximity of the water tank prevent the unit from being pivoted to inverted position without engagement. In such cases the unit is pulled outwardly on the telescoping shaft 20, prior to pivoting, to provide ample clearance. Obviously other mechanisms can be used to provide an extendable connection between the unit 10 and the mounting member 13 where such connection is required.

Figure 2:
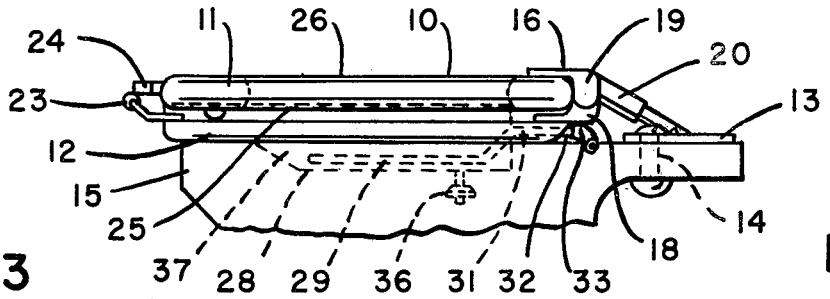
FIG. 2 is a side view of the novel toilet seat-bidet assembly of FIG. 1, attached to a conventional water closet in inverted or cover-under position, and illustrating a water-supplying hose attached thereto.

The critical elements of the present invention comprise the seat portion 11 and the cover portion 12. The seat portion 11 has a conventional U-shape with an open front. Unlike conventional seat portions it has both the upper surface 25 and the lower surface 26 rounded or contoured to adapt both of said surfaces as seating surfaces for use of the unit in either of the positions illustrated by FIGS. 1 and 2 of the drawings.

Figure 3:
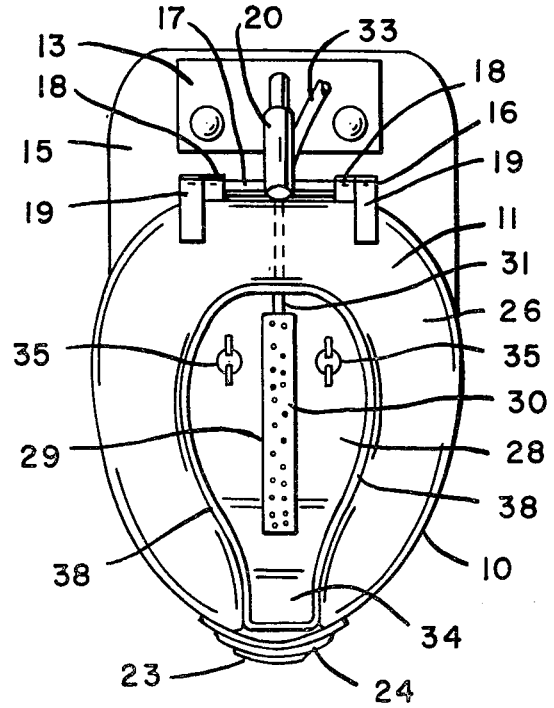
FIG. 3 is a top or plan view of the assembly of FIG. 2 taken along the line 3—3 thereof.
Figure 4:
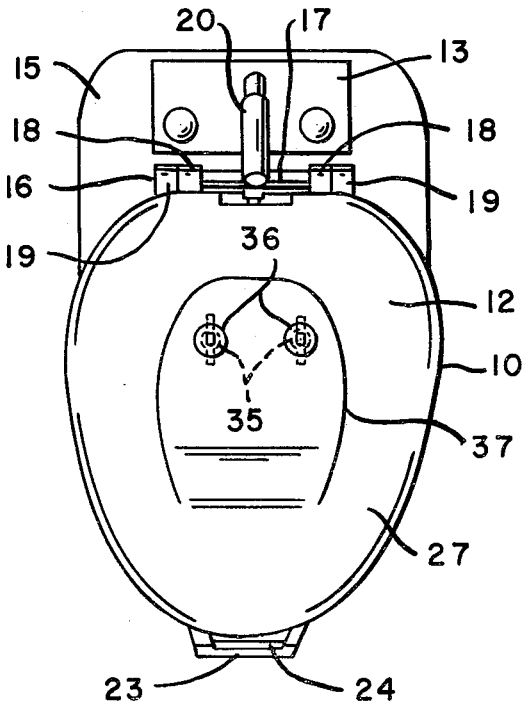
FIG. 4 is a top or plan view of the assembly of FIG. 1 with the cover portion illustrated in closed position down against the seat portion.

The cover portion 12 is a unique bidet unit comprising a generally O-shaped or U-shaped frame 27 having united thereto a central well 28, the lower surface of which is provided with a spray attachment 29, shown most clearly in FIG. 3. The spray element 29 comprises a spray head 30 provided with a multiplicity of outward openings, a water tube 31 attached to head 30 and extending through the rear portion of frame 27 to provide an external connection 32 adapted to be detachably connected to a water-supplying conduit 33 which preferably is connected to a source of water adapted to be temperature-controlled.

The central well 28 may be of any size or shape but preferably is as illustrated so as to have a front section 34 which is not as deep as the main well 28 but provides access for the hand of the user for the application of soap or medication to the body. The bottom surface of well 28 is provided with drain openings 35 which preferably are provided with gravity-opening plugs 35 to permit the well 28 to drain continuously during use. However, retention plugs may be used in cases where it is desirable to retain water or medication liquid in well 28 during use.

It is important that the upper edge of the well 28 make sealing engagement with the seat portion of the unit in the area of the central opening so that water sprayed upwardly by the spray head 30 against the body of the user will be prevented from leaking between the seat portion and cover portion onto the floor. Thus, in the embodiment illustrated, the well 28 comprises a surrounding wall 37 which extends above the flat surface of the frame 27 and preferably is provided with a compressible outer gasket 38 which sealingly engages the seat portion of the unit in the area of the central opening, as shown for instance by FIG. 3.

While the present seat-bidet units preferably are provided with a spray element, as illustrated, it may be desirable for certain uses to provide units in which the spray attachment is not present and in which the well of the seat portion is adapted to be filled with special treatment liquids or medicinal preparations for use as a sitz bath to bathe and treat portions of the body damaged by radiation treatment, infection or requiring post-operative medication.

Also, while the novel seat-bidet units of the present invention preferably are provided with means for attachment to a conventional water closet, it is possible to omit such attachment means and provide units which are adapted to be placed on the water closet and to be physically removed and inverted between normal seat-down position and cover-under or bidet position.

It should be understood that the present description, including drawings, illustrates a preferred embodiment of the present invention but that the invention is not limited to such embodiment. Certain modifications, substitutions and additions will be apparent within the skill of the art without departing from the spirit of the present invention or the scope of the present claims.

I claim:

1. A combination toilet seat and bidet assembly adapted for use on a conventional water closet to provide both a normal seat and cover assembly and also a bidet assembly, comprising a seat member and a cover member which are hingedly connected to each other adjacent the rear areas of each to adapt said members to be pivoted between open and closed positions relative to each other, said seat member comprising a generally U-shaped member having both the upper and lower surfaces thereof contoured to adapt both surfaces for use as seating surfaces for the user, said lower surface also being adapted to support said assembly on a water closet, said cover member comprising a generally U-shaped frame having an upper surface adapted to support said assembly in inverted position on a water closet and a lower surface adapted to engage the upper surface of said seat member when said assembly is in closed position, said frame substantially surrounding a central well having walls extending from said frame to the floor of said well in a direction away from the lower surface of said frame, said assembly being adapted for use in (a) normal position on said water closet in which the lower surface of said seat member engages the water closet, the upper surface of said seat member is adapted for sitting by the user and the cover member is adapted to be moved between closed position over said upper surface and open position in which it is substantially perpendicular to said seat member, and (b) inverted or bidet position on said water closet in which the upper surface of said cover member engages the water closet, the central well thereof extends within said water closet and the said seat member extends over said cover member so that said upper surface of said seat member engages the lower surface of said cover member while said lower surface of the cover member is adapted for sitting by the user.

2. A combination toilet seat and bidet assembly according to claim 1 which further comprises attachment means for attaching said assembly, adjacent the hinged connection thereof, to a conventional water closet, said attachment means comprising a sleeve element and a shaft element which is rotatably engaged within said sleeve, one of said elements being attached to said water closet and the other of said elements being attached to said assembly, adjacent the hinged connection thereof, whereby said assembly is adapted to be lifted from said water closet, rotated 180° about said shaft element to inverted position and lowered onto said water closet, said attachment being pivotable whereby said assembly is adapted for movement between normal position and inverted position without detachment from said water closet.

3. A combination toilet seat and bidet assembly according to claim 1 in which the cover member is provided with a spray element comprising a spray member adjacent the floor of the well and adapted to spray water upwardly therefrom, and with a conduit extending from said spray head to a position outside of said cover member and adapted for attachment to a source of water.

4. A combination toilet seat and bidet assembly according to claim 1 in which the walls of said well extend outwardly beyond said well and are adapted to make sealing engagement with said seat member when said members are in contact with each other in closed position.

5. A combination toilet seat and bidet assembly according to claim 4 in which the outermost edge of said walls is provided with a compressible gasket which is adapted to make sealing engagement with said seat member.

6. A combination toilet seat and bidet assembly according to claim 1 in which the floor of said well is provided with drain openings adapted to permit liquid to drain from said well into the water closet when said assembly is in inverted or bidet position.

7. A combination toilet seat and bidet assembly according to claim 6 in which said drain openings are provided with plugs adapted to seal said openings against the release of liquid from said well.

8. A combination toilet seat and bidet assembly according to claim 1 in which said seat member and said cover member are each provided with handle means adjacent the front areas of each, said handle means being in sufficiently close proximity to each other when said members are in contact with each other to enable both handle means to be grasped in one hand for purposes of lifting said assembly.

9. A combination toilet seat and bidet according to claim 1 in which said central well extends forward into the opening of said generally U-shaped member adjacent the front area of said cover member and the said U-shaped frame of said seat member has an opening in said front area, overlying said well extension in said cover member to provide the user with access to said central well when the assembly is in inverted or bidet position on a water closet.

* * * * *